US010822554B2

(12) United States Patent
Tian et al.

(10) Patent No.: US 10,822,554 B2
(45) Date of Patent: Nov. 3, 2020

(54) INTEGRATED DEVICE FOR MILLISECOND-LEVEL GAS PHASE CATALYTIC CRACKING REACTION AND SEPARATION

(71) Applicant: China University of Petroleum (East China), Qingdao (CN)

(72) Inventors: Yuanyu Tian, Qingdao (CN); Yingyun Qiao, Qingdao (CN); Jinhong Zhang, Qingdao (CN); Peijie Zong, Qingdao (CN); Yuanjun Che, Qingdao (CN); Yuan Jiang, Qingdao (CN); Fanfan Xu, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 16/671,481

(22) Filed: Nov. 1, 2019

(65) Prior Publication Data

US 2020/0140767 A1 May 7, 2020

(30) Foreign Application Priority Data

Nov. 2, 2018 (CN) ..... 2018 1 1300868

(51) Int. Cl.
*C10G 55/06* (2006.01)
*C10G 31/10* (2006.01)

(52) U.S. Cl.
CPC ..... *C10G 55/06* (2013.01); *C10G 31/10* (2013.01); *C10G 2300/4006* (2013.01); *C10G 2300/70* (2013.01)

(58) Field of Classification Search
CPC ..... C10G 55/06; C10G 31/10; C10G 2300/4006; C10G 2300/70
See application file for complete search history.

(56) References Cited

U.S. PATENT DOCUMENTS 8,415,264 B2 * 4/2013 Myers ..... B01J 29/80 502/34

* cited by examiner

*Primary Examiner* — Randy Boyer
*Assistant Examiner* — Juan C Valencia
(74) *Attorney, Agent, or Firm* — Volpe Koenig

(57) ABSTRACT

The present disclosure discloses an integrated device for millisecond-level gas phase catalytic cracking reaction and separation, comprising: a horizontal inertial cyclone separator, a horizontal inertial cyclone separator feed tube, a pyrolysis vapour inlet, a regenerated catalyst inlet, a horizontal inertial cyclone separator central tube, a cracked vapour outlet, a catalyst outlet tube, a spent catalyst silo, a first loop-seal, a riser regenerator, a settling tank, a gas-solid separator, and a second loop-seal.

10 Claims, 1 Drawing Sheet

INTEGRATED DEVICE FOR MILLISECOND-LEVEL GAS PHASE CATALYTIC CRACKING REACTION AND SEPARATION

CROSS REFERENCE TO RELATED APPLICATIONS

The application claims priority to Chinese Application No. 201811300868.8, filed on Nov. 2, 2018, entitled "For gas-phase milliseconds catalytic cracking reaction separation integrated device", which is herein specifically and entirely incorporated by reference.

FIELD

The present disclosure relates to the technical field of petroleum refining, in particular to an integrated device for millisecond-level gas-phase catalytic cracking reaction and separation.

BACKGROUND

The low-carbon olefins such as ethylene, propylene, butene and butadiene are basic organic chemical raw materials with great importance, in particular, the production capacity of ethylene is often regarded as a symbol of the development level of petrochemical industry in a country or region. Due to the booming development of energy storage battery technology and the further stringent requirements on the environmental protection, electric vehicles have emerged as a new force by virtue of the advantages of near zero pollution during the driving process, energy saving, low cost of use and can be easily intelligentialized, and it becomes an irreversible development trend that the electrical vehicles will replace the oil-fueled automobiles, the trend will result in a sharp drop in the oil consumption of transportation. It is extremely urgent for the oil processing enterprises to plan in advance and transform the petroleum processing pattern from "fuel oil-oriented mode" to "chemical product-oriented mode".

At present, about 95% of ethylene and 66% of propylene in the world are produced by performing thermal cracking of light raw materials such as natural gas, naphtha or light diesel oil with a tube furnace. However, given that the conventional crude oil resources have been gradually exhausted since the beginning of the 21st century, the crude oil supply in the world has shown a trend of densification and inferior quality, which leads to a relative deficiency of light raw material for cracking; on the other hand, the worldwide market demand for low carbon olefins is rapidly growing. In order to alleviate the discrepancy, broaden the raw materials for producing low carbon olefins, and make better use of heavy crude oil, the petroleum refining industry at home and abroad strives to develop a "chemical product-oriented mode" technical route that uses heavy oil as a raw material to directly produce low carbon olefins through catalytic cracking process, the technical route has become the focus and hotspot of current research and attention in the petroleum refining industry, while few mature technologies can be industrialized.

The inferior heavy oil exhibits the resource characteristics such as a high content of polycyclic aromatic hydrocarbons, high carbon/hydrogen-ratio and viscosity and large density, excessive content of sulfur, nitrogen, oxygen, residual carbon, heavy metals and mechanical impurities, and being prone to perform condensation and generate petroleum coke;

the resource characteristics form a huge challenge for the conventional processing routes of heavy oil, a majority of the existing heavy oil processing technologies are difficult to meet the requirements of efficient and clean processing during implementing the "chemical product-oriented mode". Delayed coking is the preferred technology at present for processing the inferior heavy oil, but it faces many challenges such as high output of inferior high-sulfur coke, low yield of coking wax oil, difficulties in processing inferior heavy oil with "chemical product-oriented mode", great pressure of environmental protection resulting from emission of large amount of volatiles, and the potential safety hazard caused by the shot coke; catalytic cracking and hydrocracking technology for processing inferior heavy oil face with many problems, such as low conversion rate, low selectivity and yield of olefin products, fast deactivation and excessively large consumption of catalyst, poor stability of the device and excessively high processing cost; solvent deasphalting technology used in the processing of inferior heavy oil also face with many challenges, for example, the yield of deasphalted oil is low, it is difficult to implement processing with "chemical product-oriented mode", the utilization route of hard asphalt with high efficiency and large amount becomes the bottleneck of its industrialization; the heavy oil suspended bed hydrogenation technology can theoretically meet the requirements of efficient and clean pretreatment of inferior heavy oil, however, the urgent problems concerning low conversion rate, excessive consumption of hydrogen, low removal rate of heavy metals, tail oil processing and low-cost hydrogen source shall be solved, the technological process and equipment matching are still flawed, there is not successful large-scale industrial application yet; in addition, the hydrogenation wax oil needs a secondary processing to implement the "chemical product-oriented mode", and the reciprocating cycle of hydrogenation and dehydrogenation during the process causes excessive energy consumption and poor economic performance.

Many new technologies for the prolific production of low carbon olefins by catalytic cracking heavy oil have been developed at home and abroad in recent years, the new technologies have attracted extensive attention from the industry and put into pilot applications, such as the DCC and CPP processes developed by the Sinopec Research Institute of Petroleum Processing in China, PetroFCC process developed by Universal Oil Products (UOP) LLC in United States of America (USA), the HS-FCC process and THR process developed by Japan Petroleum Energy Center, the TCSC process developed by the German Institute of Organic Chemistry, the INDMAX (UCC) process developed by Indian Oil Corporation, the Maxofin process jointly developed by Exxon Mobil and Kellogg Company, and two-stage riser catalytic cracking (TMP) process proposed by China University of Petroleum. As compared with steam cracking, the catalytic cracking of heavy oil has advantages in the aspects of widened range of raw materials for producing olefins, low reaction temperature, easy adjustment of product distribution and low energy consumption. However, on the one hand, these catalytic cracking technologies should adopt the operation mode of high temperature, short residence time, large catalyst-oil ratio and high water-oil ratio. On the other hand, because both the composition of the raw materials and the properties of the catalyst are key factors affecting the yield and distribution of the catalytic cracking products during the catalytic cracking operation, and the active ingredients of the shape selecting catalyst for catalytic cracking of heavy oil are mainly ZSM-5 and Y-type molecular sieves, their pore structure is small, the diffusion of large molecules of heavy oil are limited during the mass transfer process, and they cannot easily enter into the molecular sieves for performing shape selecting cracking; moreover, the strong hydrogen transfer performance of the acidic molecular sieves, the improved ranges of yield and selectivity of the olefins subject to restriction. In addition, the heavy oil macromolecules accumulated on the surface of molecular sieves are prone to be excessively cracked under the action of acid sites, resulting in the undesirable distribution of the products or coking and condensation, thereby blocking the pore canals of catalyst. At present, the existing industrial shape selecting catalysts are used for producing low carbon olefins by catalytic cracking of inferior raw materials such as atmospheric residue, vacuum residue and deasphalted oil, the process often leads to many problems, namely catalyst poisoning, poor atomization effect, large output of coke, and the conversion rate and selectivity are greatly reduced. Furthermore, during the existing hot processing of heavy oil, the hydrocarbon reaction mainly occurs in the form of liquid phase reaction; the hydrocarbon molecules in the gas phase can be quickly dispersed after being split into free radicals, while the free radicals in the liquid phase are encircled by the surrounding molecules which act like "a cage", and the polycondensation reaction will be exacerbated; in order to disperse the free radicals formed in the process, the free radicals need to overcome the extra potential barrier (i.e., the so-called "cage effect") so as to diffuse out of the "cage"; relative to the gas phase reaction, the "cage effect" will cause the liquid phase reaction process to reduce selectivity of the gaseous products and to produce more polymer, while the gas phase reaction process may increase the content of olefins in the gaseous product, thereby implementing the "chemical product-oriented mode" during the crude oil processing.

At present, it is urgently needed to develop supporting equipment for gas phase oil and gas mixing with catalyst in milliseconds, millisecond-level reaction and millisecond-level separation to ensure the implementation of technological process of producing olefins and aromatic hydrocarbons by fractionation and gas phase catalytic cracking of crude oil.

SUMMARY

A purpose of the present disclosure is to overcome the deficiencies of the existing petrochemical type processing equipment thereby provide an integrated device for millisecond-level gas phase catalytic cracking reaction and separation, the integrated device for millisecond-level gas phase catalytic cracking reaction and separation provided by the present disclosure ensures implementation of technological process of producing olefins and aromatic hydrocarbons by fractionation and gas phase catalytic cracking of crude oil.

In order to fulfill the above-mentioned purpose, the present disclosure provides an integrated device for millisecond-level gas phase catalytic cracking reaction and separation, the device comprises: a horizontal inertial cyclone separator, a horizontal inertial cyclone separator feed tube, a pyrolysis vapour inlet, a regenerated catalyst inlet, a horizontal inertial cyclone separator central tube, a cracked vapour outlet, a catalyst outlet tube, a spent catalyst silo, a first loop-seal, a riser regenerator, a settling tank, a gas-solid separator and a second loop-seal; wherein an inlet of horizontal inertial cyclone separator feed tube of the horizontal inertial cyclone separator is connected with the pyrolysis vapour inlet, a regenerated catalyst inlet is disposed at a middle part of the horizontal inertial cyclone separator feed tube, the catalyst outlet tube of said horizontal inertial cyclone separator is connected with the spent catalyst silo, the cracked vapour outlet is disposed at the horizontal inertial cyclone separator central tube; the spent catalyst silo is connected with the riser regenerator via the first loop-seal, the settling tank and the gas-solid separator are disposed at the top of the riser regenerator; the settling tank is connected with the regenerated catalyst inlet via the second loop-seal.

The integrated device for millisecond-level gas phase catalytic cracking reaction and separation provided by the present disclosure uses the horizontal inertial cyclone separator feed tube of the horizontal inertial cyclone separator as the reactor of gas phase pyrolysis vapour mixing with the catalyst in milliseconds and catalytic cracking, thereby ensure the production of low carbon olefins and aromatic hydrocarbons with high conversion rate and selectivity by means of gas-solid catalysis of pyrolysis vapour under the conditions of high temperature and ultra-short time; the separation of oil gas and spent catalyst in milliseconds is performed in a short separation distance of less than half circle of the horizontal inertial cyclone separator, it significantly reduces the secondary reaction of cracked vapour, guarantees the high selectivity of the low-carbon olefins and aromatic hydrocarbons; due to the gas phase reaction between the pyrolysis vapour and the spent catalyst is performed within milliseconds, the "cage effect" of liquid phase reaction is eliminated, the amount of generated coke is greatly reduced; in addition, the spent catalyst has a high temperature, it is prone to ignite; the riser regenerator in use has the capabilities of rapidly combusting coke with high strength to reduce back-mixing of the catalyst, it also solves the difficult problem of lifting the high-temperature catalyst, facilitates the recycling of the regenerated catalyst and formation of the solid material seal, avoids the potential safety hazard caused by blending of the flue gas and the pyrolysis vapour. The integrated device for millisecond-level gas phase catalytic cracking reaction and separation provided by the present disclosure ensures implementation of technological process of producing olefins and aromatic hydrocarbons by fractionation and gas phase catalytic cracking of crude oil.

| Description of the reference signs | |
|---|---|
| 1. horizontal inertial cyclone separator | 2. horizontal inertial cyclone separator feed tube |
| 3. pyrolysis vapour inlet | 4. regenerated catalyst inlet |
| 5. horizontal inertial cyclone separator | 6. cracked vapour outlet central tube |
| 7. catalyst outlet tube | 8. spent catalyst silo |
| 9. first loop-seal | 10. riser regenerator |
| 11. settling tank | 12. gas-solid separator |
| 13. second loop-seal | |

DETAILED DESCRIPTION

The terminals and any value of the ranges disclosed herein are not limited to the precise ranges or values, such ranges or values shall be comprehended as comprising the values adjacent to the ranges or values. As for numerical ranges, the endpoint values of the various ranges, the endpoint values and the individual point value of the various ranges, and the individual point values may be combined with one another to produce one or more new numerical ranges, which should be deemed have been specifically disclosed herein.

Unless otherwise stated, the orientation words in the present disclosure such as "up, down, left, right, top and bottom" generally refer to the upper, lower, leftward and rightward positions, the top and bottom as shown in the reference drawings. The orientation words in use, such as "inside and outside", refer to the inside and outside relative to the contour of individual component. The term "inertial cyclone separator" refers to a combination separator of inertial separator and cyclone separator. The term "pyrolysis vapour" refers to oil and gas produced from pyrolysis reaction, and specifically, the pyrolysis vapour is at a temperature of 350-650° C. and produced from heating and vaporization of the light crude oil or pyrolysis of heavy oil.

Figure 1:
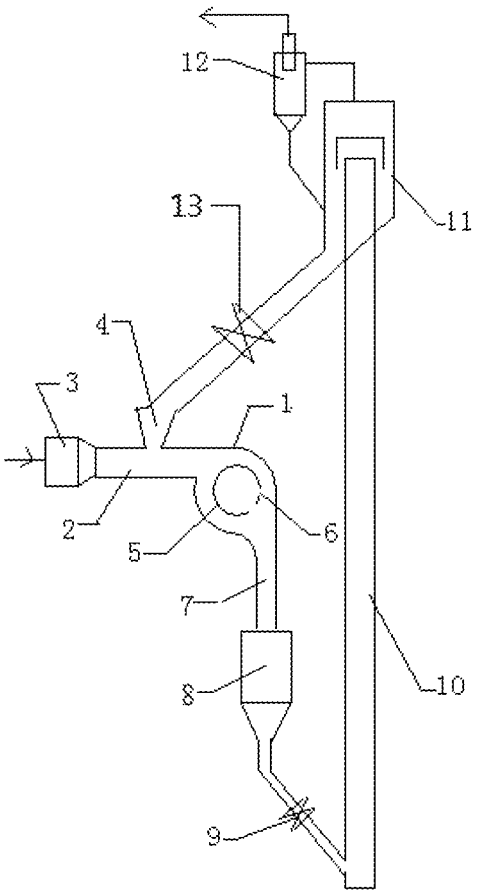
FIG. 1 illustrates a schematic view of an integrated device for millisecond-level gas phase catalytic cracking reaction and separation according to a specific embodiment of the present disclosure.
Figure 2:
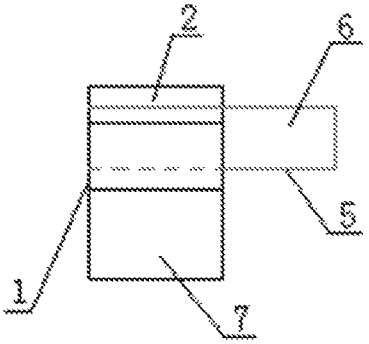
FIG. 2 illustrates a cross-sectional view of a horizontal inertial cyclone separator according to a specific embodiment.

The present disclosure provides an integrated device for millisecond-level gas phase catalytic cracking reaction and separation, as shown in FIG. 1 and FIG. 2, the device comprises: a horizontal inertial cyclone separator 1, a horizontal inertial cyclone separator feed tube 2, a pyrolysis vapour inlet 3, a regenerated catalyst inlet 4, a horizontal inertial cyclone separator central tube 5, a cracked vapour outlet 6, a catalyst outlet tube 7, a spent catalyst silo 8, a first loop-seal 9, a riser regenerator 10, a settling tank 11, a gas-solid separator 12 and a second loop-seal 13; wherein an inlet of horizontal inertial cyclone separator feed tube 2 of the horizontal inertial cyclone separator 1 is connected with the pyrolysis vapour inlet 3, the regenerated catalyst inlet 4 is disposed at a middle part of the horizontal inertial cyclone separator feed tube 2, the catalyst outlet tube 7 of said horizontal inertial cyclone separator 1 is connected with the spent catalyst silo 8, the cracked vapour outlet 6 is disposed at the horizontal inertial cyclone separator central tube 7; the spent catalyst silo 8 is connected with the riser regenerator 10 via the first loop-seal 9, the settling tank 11 and the gas-solid separator 12 are disposed at the top of the riser regenerator 10; the settling tank 11 is connected with the regenerated catalyst inlet 4 via the second loop-seal 13.

The integrated device provided by the present disclosure uses the horizontal inertial cyclone separator feed tube 2 of said horizontal inertial cyclone separator as a reactor of the mixing and reaction of gas-phase pyrolysis vapour and the catalyst in milliseconds and the separation distance less than half circle of the horizontal inertial cyclone separator, in order to perform separation of the oil gas and catalyst in milliseconds, and allow the spent catalyst to pass through the riser regenerator to produce the regenerated catalyst and form the cycle of catalyst, thereby ensuring implementation of technological process of producing olefins and aromatic hydrocarbons by fractionation and gas phase catalytic cracking of crude oil.

According to a preferred embodiment of the present disclosure, the device is consisting of a horizontal inertial cyclone separator 1, a horizontal inertial cyclone separator feed tube 2, a pyrolysis vapour inlet 3, a regenerated catalyst inlet 4, a horizontal inertial cyclone separator central tube 5, a cracked vapour outlet 6, a catalyst outlet tube 7, a spent catalyst silo 8, a first loop-seal 9, a riser regenerator 10, a settling tank 11, a gas-solid separator 12 and a second loop-seal 13.

The horizontal inertial cyclone separator 1 of the present disclosure is provided with a horizontal inertial cyclone separator feed tube 2, a horizontal inertial cyclone separator central tube 5 and a catalytic outlet tube 6. An inlet of horizontal inertial cyclone separator feed tube 2 is connected with the pyrolysis vapour inlet 3, the regenerated catalyst inlet 4 is disposed at a middle part of the horizontal inertial cyclone separator feed tube 2, the pyrolysis vapour and the regenerated catalyst enter the horizontal inertial cyclone separator feed tube 2 through the pyrolysis vapour inlet 3 and the regenerated catalyst inlet 4, respectively; the horizontal inertial cyclone separator feed tube 2 is used as a reactor for gas-phase pyrolysis vapour mixing with catalyst in milliseconds and catalytic cracking. The position of the regenerated catalyst inlet 4 disposed on the horizontal inertial cyclone separator feed tube 2 is not particularly limited in the present disclosure, if only it meets the requirement that the pyrolysis vapour and the regenerated catalyst may contact and react with each other. The present disclosure defines that the regenerated catalyst inlet 4 is disposed at a middle part of the horizontal inertial cyclone separator feed tube 2, wherein the expression "middle part" refers to an optional position between an end of the horizontal inertial cyclone separator feed tube 2 being proximate to the pyrolysis vapour inlet 3 and another end being distal from the horizontal inertial cyclone separator feed tube 2, preferably the middle position between an end of the horizontal inertial cyclone separator feed tube 2 being proximate to the pyrolysis vapour inlet 3 and another end being distal from the horizontal inertial cyclone separator feed tube 2.

The present disclosure has a wide selection range in regard to the shape of the horizontal inertial cyclone separator feed tube 2. Preferably, the horizontal inertial cyclone separator feed tube 2 is a flat rectangular feed tube.

The present disclosure has a wide selection range with respect to the arrangement form of the horizontal inertial cyclone separator feed tube 2, and preferably, the horizontal inertial cyclone separator feed tube 2 of the horizontal inertial cyclone separator 1 is arranged horizontally, or arranged vertically, or disposed with an angled arrangement therebetween.

According to the present disclosure, preferably, the reaction temperature in the horizontal inertial cyclone separator feed tube 2 is within a range of 480-650° C., the air velocity of pyrolysis vapour is 6-25 m/s, and the residence time in the feed tube is 10-1,000 ms. The pyrolysis vapour and the regenerated catalyst subject to a reaction in milliseconds in the horizontal inertial cyclone separator feed tube 2 so as to obtain a gas-solid mixture.

According to the present disclosure, the shape of the cracked vapour outlet 6 is not particularly limited, preferably it has a long strip shape. The number of cracked vapour outlets can be selected within a wide range, it may be 1 or more. Further preferably, the horizontal inertial cyclone separator central tube 5 is opened with 1 or more strip-shaped cracked vapour outlets 6. Preferably, the long strip-shaped cracked vapour outlets 6 are disposed in parallel with the horizontal inertial cyclone separator central tube 5.

According to a preferred embodiment of the present disclosure, the horizontal inertia center tube 5 is opened with 1 or more long strip-shaped cracked vapour outlets 6; the long strip-shaped cracked vapour outlets 6 are distributed within an angle ranging from 70° to 180° formed counterclockwise along a wall of the horizontal inertia center tube 5 relative to an inlet of the horizontal inertial feed tube 2. In the preferred embodiment, the gas-solid mixture obtained by mixing and reacting the pyrolysis vapour and the catalyst in milliseconds flows into the horizontal inertia 1 to perform a gas-solid separation, and subjects to a centrifugation-oriented separation for milliseconds in the horizontal inertia 1 with an angle ranging from 70° to 180°, more than 95% of the post-reaction catalyst (spent catalyst) flows from the catalyst outlet pipe 7 into the spent catalyst silo 8; more than 90% of the cracked oil gas is discharged from the cracked vapour outlet 6 into the horizontal inertial center pipe 5 and enters into the subsequent system, such as a subsequent fractionation system. Less than 10% of the cracked vapour entrained with less than 5% of the spent catalyst rotates and enters into the cyclic separation.

The spent catalyst silo 8 according to the present disclosure is used for receiving the spent catalyst which is discharged from the catalyst outlet pipe 7.

The spent catalyst passes through the first loop-seal 9 and enters into the riser regenerator 10. The riser regenerator 10 of the present disclosure may be the commonly-used riser regenerator in the art. Specifically, the riser regenerator 10 may be a straight tube riser reactor, or an impulse riser reactor formed by a straight tube combination with different tube diameters. With respect to the size of the riser reactor, those skilled in the art can make a suitable choice according to the requirement of processing capacity.

In the riser regenerator 10, the spent catalyst mixes with the regeneration air and burns the petroleum coke for regeneration. The regeneration condition in the riser regenerator 10 of the present disclosure is not particularly limited, and burning the petroleum coke for regeneration of the spent catalyst may be carried out in accordance with the conventional means in the art. Preferably, the reaction temperature at an outlet of the riser regenerator 10 is within a range of 550-700° C.

The regenerated gas-solid mixture settled in the settling tank 11 disposed at the top of the riser regenerator 10 to implement a coarse fractionation of the gas-solid phase, the gas-solid mixture is then delivered to the gas-solid separator 12 for performing fine separation. According to the present disclosure, preferably, the gas phase outlet of the gas-solid separator 12 is connected with the flue gas discharging and subsequent section. The gas phase separated from the gas-solid separator 12 passes through a gas phase outlet and enters the subsequent section to perform treatment of tail gas. According to the present disclosure, preferably, the solid phase outlet of the gas-solid separator 12 is connected with the regenerated catalyst inlet 4. The solid phase outlet of the gas-solid separator 12 may be directly connected with the regenerated catalyst inlet 4 via a pipeline, or the solid phase outlet of the gas-solid separator 12 may be connected with the settling tank 11 through a pipeline to realize the communication between the solid phase outlet of the gas-solid separator 12 and the regenerated catalyst inlet 4. In the preferred embodiment, the regenerated catalyst obtained from the solid phase outlet of the gas-solid separator 12 is recycled by flowing from the regenerated catalyst inlet 4 and entering into the horizontal inertial cyclone separator feed tube 2.

The present disclosure has a wide range of selection in regard to the gas-solid separator 12, if only the gas-solid separator can perform the gas-solid separation of the regenerated catalyst and the flue gas obtained after regeneration. According to a specific embodiment of the present disclosure, the gas-solid separator 12 may be one of a vertical cyclone separator, a horizontal cyclone separator and an inertial separator or a combination thereof.

According to the present disclosure, the settling tank 11 is in communication with the regenerated catalyst inlet 4 via the second loop-seal 13, so as to send the regenerated catalyst precipitated in the settling tank 11 to the horizontal inertial cyclone separator feed tube 2 through the regenerated catalyst inlet 4 thereby contact and react with the pyrolysis vapour.

The expressions "first" and "second" in the "first loop-seal" and the "second loop-seal" of the present disclosure do not impose a definitive function on the loop-seals, but only serve to distinguish the loop-seals disposed in different positions. The first loop-seal 9 and the second loop-seal 13 may be identical or different, it is not particularly limited in the present disclosure. According to a specific embodiment of the present disclosure, the first loop-seal 9 and the second loop-seal 13 are independently a non-mechanical control valve or a mechanical control valve. The types of non-mechanical control valve or mechanical control valve may fall into the conventional choices in the art.

Preferably, the non-mechanical control valve is one of an L-type return feeder, a U-type return feeder, a J-type return feeder and an N-type return feeder or a combination thereof.

Preferably, the mechanical control valve is a hydraulic sliding plug valve or an electric sliding plug valve.

The integrated device for millisecond-level gas phase catalytic cracking reaction and separation provided by the present disclosure will be further described below with reference to the appended figures, but the figures do not hence confine the present disclosure.

FIG. 1 illustrates a schematic view of an integrated device for millisecond-level gas phase catalytic cracking reaction and separation according to a specific embodiment of the present disclosure. As shown in FIG. 1, the device comprises: a horizontal inertial cyclone separator 1, a horizontal inertial cyclone separator feed tube 2 (preferably horizontally arranged), a pyrolysis vapour inlet 3, a regenerated catalyst inlet 4, a horizontal inertial cyclone separator central tube 5, a cracked vapour outlet 6, a catalyst outlet tube 7, a spent catalyst silo 8, a first loop-seal 9, a riser regenerator 10, a settling tank 11, a gas-solid separator 12 and a second loop-seal 13; the horizontal inertial cyclone separator central tube 5 is opened with 1 or more strip-shaped cracked vapour outlets; the long strip-shaped cracked vapour outlets 6 are distributed within an angle ranging from 70° to 180° formed counterclockwise along a wall of the horizontal inertia center tube 5 relative to an inlet of the horizontal inertial feed tube 2. The flat rectangular feed tube of the horizontal inertial cyclone separator 1 is connected with the pyrolysis vapour inlet 3, the regenerated catalyst inlet 4 is disposed at a middle part of the flat rectangular feed tube. The pyrolysis vapour, at a temperature of 350-650° C., which is produced from heating and vaporization of the light crude oil or pyrolysis of heavy oil, does not subject to condensation, but directly passes through the pyrolysis vapour inlet 3 and is injected into the flat rectangular feed tube at a velocity of 6-25 m/s, mixes in milliseconds with the regenerated catalyst at a temperature of 550-700° C. influent from the regenerated catalyst inlet 4, and reacts in milliseconds at a temperature of 480-650° C., the obtained gas-solid mixture then flows into the horizontal inertial cyclone separator 1 at a velocity of 10-30 m/s to perform a gas-solid separation; and subjects to a centrifugation-oriented separation for milliseconds in the horizontal inertia 1 with an angle ranging from 70° to 180°, more than 95% of the post-reaction catalyst (spent catalyst) flows from the catalyst outlet pipe 7 into the spent catalyst silo 8; more than 90% of the cracked oil gas is discharged from the cracked vapour outlet 6 into the horizontal inertial center pipe 5 and enters into the subsequent fractionation system. Less than 10% of the cracked vapour entrained with less than 5% of the spent catalyst rotates and enters into the cyclic separation. The spent catalyst passes through the first loop-seal 9 and enters into the riser regenerator 10 and then burns the petroleum coke for regeneration. The regenerated gas-solid mixture enters and settles in the settling tank 11 at an outlet of the riser regenerator 10 under a reaction temperature of 550-700° C. to implement a coarse fractionation of the gas-solid phase, the gas-solid mixture is then transmitted to the gas-solid separator 12 for performing fine separation; the high-temperature regeneration flue gas is discharged through a gas phase outlet of the gas-solid separator 12 and delivers to the subsequent section. The high-temperature regenerated catalyst obtained from the solid phase outlet of the gas-solid separator 12 and the high-temperature regenerated catalyst obtained in the settling tank 11 are transmitted to the regenerated catalyst inlet 4 through the second loop-seal 13 and sent to the flat rectangular feed tube to react with the pyrolysis vapour.

The integrated device for millisecond-level gas phase catalytic cracking reaction and separation provided by the present disclosure uses the horizontal inertial cyclone separator feed tube as the reactor of pyrolysis vapour mixing with the catalyst in milliseconds and catalytic cracking, thereby ensuring the production of low carbon olefins and aromatic hydrocarbons with high conversion rate and selectivity by means of gas-solid catalysis of pyrolysis vapour under the conditions of high temperature and ultra-short time; the separation of oil gas and spent catalyst in milliseconds is performed in a short separation distance of less than half circle of the horizontal inertial cyclone separator, it significantly reduces the secondary reaction of cracked vapour, guarantees the high selectivity of the low-carbon olefins and aromatic hydrocarbons; given that the gas phase reaction between the pyrolysis vapour and the spent catalyst is performed at milliseconds, the "cage effect" of liquid phase reaction is eliminated, the amount of generated coke is greatly reduced; in addition, the spent catalyst has a high temperature, it is prone to ignite; the riser regenerator in use has the capabilities of rapidly combusting coke with high strength to reduce back-mixing of the catalyst, it also solves the difficult problem of lifting the high-temperature catalyst, facilitates the recycling of the regenerated catalyst and formation of the solid material seal, avoids the potential safety hazard caused by blending of the flue gas and the pyrolysis vapour. The integrated device for catalytic cracking reaction and separation of oil gas uses a coupling of the horizontal inertial cyclone separator and riser regenerator, its investment is reduced by 60% compared with the ordinary petroleum catalytic cracking unit, the yield of olefins is increased by more than 1.2 times, the propylene selectivity is improved by 1.7 times, thereby implementing the efficient and clean processing of petroleum with the "chemical product-oriented mode".

The above content specifies the preferred embodiments of the present disclosure, but the present disclosure is not limited thereto. A variety of simple modifications can be made to the technical solutions of the present disclosure within the scope of the technical concept of the present disclosure, including a combination of individual technical features in any other suitable manner, such simple modifications and combinations thereof shall also be regarded as the content disclosed by the present disclosure, each of them falls into the protection scope of the present disclosure.

The invention claimed is:

1. An integrated device for millisecond-level gas phase catalytic cracking reaction and separation, comprising: a horizontal inertial cyclone separator, a horizontal inertial cyclone separator feed tube, a pyrolysis vapour inlet, a regenerated catalyst inlet, a horizontal inertial cyclone separator central tube, a cracked vapour outlet, a catalyst outlet tube, a spent catalyst silo, a first loop-seal, a riser regenerator, a settling tank, a gas-solid separator and a second loop-seal; an inlet of horizontal inertial cyclone separator feed tube of the horizontal inertial cyclone separator is connected with the pyrolysis vapour inlet, the regenerated catalyst inlet is disposed at a middle part of the horizontal inertial cyclone separator feed tube, the catalyst outlet tube of said horizontal inertial cyclone separator is connected with the spent catalyst silo, the cracked vapour outlet is disposed at the horizontal inertial cyclone separator central tube; the spent catalyst silo is connected with the riser regenerator via the first loop-seal, the settling tank and the gas-solid separator are disposed at the top of the riser regenerator; the settling tank is connected with the regenerated catalyst inlet via the second loop-seal.

2. The integrated device for millisecond-level gas phase catalytic cracking reaction and separation according to claim 1, wherein a gas phase outlet of the gas-solid separator is connected with a flue gas discharging.

3. The integrated device for millisecond-level gas phase catalytic cracking reaction and separation according to claim 1, wherein the horizontal inertial cyclone separator feed tube is a flat rectangular feed tube.

4. The integrated device for millisecond-level gas phase catalytic cracking reaction and separation according to claim 1, wherein feeding direction of the horizontal inertial cyclone separator feed tube of the horizontal inertial cyclone separator is arranged horizontally, or arranged vertically, or disposed with an angled arrangement therebetween.

5. The integrated device for millisecond-level gas phase catalytic cracking reaction and separation according to claim 1, wherein the horizontal inertial cyclone separator central tube is opened with 1 or more strip-shaped cracked vapour outlets; the long strip-shaped cracked vapour outlets are distributed within an angle ranging from 70° to 180° formed counterclockwise along a wall of the horizontal inertia center tube relative to an inlet of the horizontal inertial feed tube.

6. The integrated device for millisecond-level gas phase catalytic cracking reaction and separation according to claim 1, wherein the gas-solid separator is one of a vertical cyclone separator, a horizontal cyclone separator and an inertial separator.

7. The integrated device for millisecond-level gas phase catalytic cracking reaction and separation according to claim 1, wherein the first loop-seal and the second loop-seal are independently a non-mechanical control valve or a mechanical control valve.

8. The integrated device for millisecond-level gas phase catalytic cracking reaction and separation according to claim 7, wherein the non-mechanical control valve is one of an L-type return feeder, a U-type return feeder, a J-type return feeder and an N-type return feeder or a combination thereof.

9. The integrated device for millisecond-level gas phase catalytic cracking reaction and separation according to claim 7, wherein the mechanical control valve is a hydraulic sliding plug valve or an electric sliding plug valve.

10. The integrated device for millisecond-level gas phase catalytic cracking reaction and separation according to claim 7, wherein the riser regenerator is a straight tube riser reactor, or an impulse riser reactor formed by a straight tube combination with different tube diameters.

* * * * *